US008740645B2

(12) United States Patent
Hirabayashi et al.

(10) Patent No.: US 8,740,645 B2
(45) Date of Patent: Jun. 3, 2014

(54) TERMINAL FITTING

(75) Inventors: Osamu Hirabayashi, Yokkaichi (JP); Michiaki Okamoto, Yokkaichi (JP); Yutaka Noro, Yokkaichi (JP); Daisuke Hirasawa, Yokkaichi (JP); Yoshihiro Mizutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 28 days.

(21) Appl. No.: 13/609,800

(22) Filed: Sep. 11, 2012

(65) Prior Publication Data

US 2013/0065459 A1 Mar. 14, 2013

(30) Foreign Application Priority Data

Sep. 14, 2011 (JP) ..... 2011-200415

(51) Int. Cl.
*H01R 13/40* (2006.01)

(52) U.S. Cl.
USPC ..... 439/595

(58) Field of Classification Search
USPC ..... 439/752.5, 595
See application file for complete search history.

(56) References Cited

U.S. PATENT DOCUMENTS

| | | | | |
|---|---|---|---|---|
| 6,325,680 | B1 | 12/2001 | Suzuki | |
| 6,572,417 | B2 * | 6/2003 | Katsuma | 439/752.5 |
| 6,976,874 | B2 | 12/2005 | Sakurai et al. | |
| 7,147,522 | B2 * | 12/2006 | Kobayashi et al. | 439/852 |
| 7,204,728 | B2 * | 4/2007 | Noro et al. | 439/852 |
| 7,311,561 | B2 * | 12/2007 | Anbo et al. | 439/752.5 |
| 7,371,132 | B2 * | 5/2008 | Tanaka | 439/752.5 |
| 2002/0111082 | A1 | 8/2002 | Murakami et al. | |
| 2003/0068932 | A1 | 4/2003 | Takatsuki et al. | |
| 2003/0096542 | A1 | 5/2003 | Kojima | |
| 2004/0224576 | A1 | 11/2004 | Murakami et al. | |
| 2008/0146090 | A1 | 6/2008 | Shimizu | |

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A terminal fitting (T) includes a locking plate (19) extending from a first side plate (17) and a stabilizer (22) projecting from a second side plate (18). A cutout (35) is formed at the extending end edge of the locking plate (19) and engages the stabilizer (22) to restrict relative displacements of the locking plate (19) and the second side plate (18) to define a first linking portion (27) that links the base plate (16) and a first contact piece (23). A second linking portion (28) links the second side plate (18) and a second contact piece (24). A restricting portion (36) is formed on the locking plate (19) and restricts displacement of the second contact piece (24) away from the first plate-like contact piece (23).

10 Claims, 8 Drawing Sheets

TERMINAL FITTING

BACKGROUND OF THE INVENTION

1. Field of the Invention

The invention relates to a terminal fitting.

2. Description of the Related Art

U.S. Pat. No. 6,976,874 discloses a male terminal fitting that has a rectangular tube with a lock and a tab projecting forward from the rectangular tube. The male terminal fitting is inserted in a terminal accommodating chamber of a housing from behind and the lock engages a locking lance of the terminal accommodating chamber to restrict displacement of the terminal fitting in a withdrawing direction. The rectangular tube has a base plate, first and second side plates extending substantially at a right angle from both left and right sides of the base plate and a locking plate extending substantially at a right angle from the extending end edge of the first side plate. A plate-like stabilizer is formed on the first side plate and projects out from the rectangular tube. The first side plate, the base plate and the second side plate are connected successively to a lateral edge of a locking wall via substantially right-angled fold lines, and the base plate and the side plates form a three-plate portion. The base plate is connected to a bottom wall of a wire crimping portion in the form of an open barrel.

A backward pulling force on a wire fixed to the wire crimping portion can improperly deform the rectangular tube of the terminal fitting since the three plate portion is connected to the wire crimping portion and to the locking plate whose backward displacement is restricted by engagement with the locking lance.

Thought has been given to a design change to prevent deformation of the tube. More particularly, the lock that engages the locking lance could be formed on a ceiling plate that extends from the second side plate and that is not connected directly to the locking plate. A cutout could be formed at a lateral edge of the ceiling plate and could engage the stabilizer in forward and backward directions to restrict relative displacements of the ceiling plate and the three-plate portion in forward and backward directions, thereby preventing improper deformation of the rectangular tube.

However, a force acts on engaged parts of the stabilizer and the cutout in a direction to move the stabilizer and the cutout away from each other in a plate thickness direction of the stabilizer. An engagement margin of the stabilizer in the plate thickness direction is very small as compared with an engagement margin in a projecting direction of the stabilizer. Thus, a strong wire pulling force could disengage the stabilizer and the cutout so that the rectangular tube may be deformed improperly.

The invention was completed in view of the above situation and an object thereof is to prevent improper deformation of a tube.

SUMMARY OF THE INVENTION

The invention relates to a terminal fitting that has a tube formed with a lock to be engaged with a locking lance in a terminal accommodating chamber of a connector housing. A tab extends forward from the tube and has first and second plate-like contact pieces placed one over the other while being linked along a fold line that extends in forward and backward directions. A wire connection portion extends back from the tube. The tube comprises a base plate and first and second side plates that project from the base plate. A locking plate projects from the first side plate and is formed with the lock. At least one plate-shaped stabilizer projects out from the second side plate. A first link links the front end of the base plate and the rear end of the first contact piece. A second link links the front end of the second side plate and the rear end of the second contact piece. A restricting portion is formed on one of the locking plate, the first side plate and the base plate and is configured to contact at least one of the second link and the second contact piece to restrict a displacement of the second contact piece away from the first contact piece.

A strong pulling force on the base plate may incline the second side plate out in an opening direction. Displacement of the second side plate in the opening direction could disengage the stabilizer from the cutout and creates forces that could displace the second contact piece away from the first contact piece. However, the second link integrally or unitarily connects the second side plate to the second contact piece of the tab to avoid an improper deformation of the tube. Additionally, the restricting portion restricts displacement of the second contact piece of the tab away from the first contact piece.

The base plate preferably is substantially parallel to the plate-like contact pieces of the tab and is connected to a base wall of the wire connection portion.

The stabilizer preferably is a plate projecting out from the extending edge of the second side plate of the tube and is substantially parallel to the second side plate.

The locking plate of the tube may comprise at least one cutout or recess engaged with the stabilizer to restrict displacements of the locking plate and the second side plate in forward and backward directions.

The cutout or recess preferably is formed by recessing the extending end edge of the locking plate.

A backward pulling force may act on the base plate via the wire crimping portion. However, the base plate is connected directly to the second side plate, which has the stabilizer engaged in the cutout of the locking plate whose backward displacement is restricted by engagement with the locking lance. Thus, the locking plate cannot displace forwardly relative to the second plate and the rectangular tube cannot deform improperly.

The second side plate is connected integrally or unitarily to the second contact piece of the tab via the second link. Displacement of the second side plate in the opening direction could displace the second contact piece away from the first contact piece. However, the second contact piece is displaced integrally with the second side plate and the restricting portion restricts a displacement of the second contact piece of the tab away from the first contact piece of the tab. The restriction of displacement second contact piece also restricts displacement of the second side plate in the opening direction. Therefore, disengagement of the stabilizer from the cutout can be reliably prevented.

The restricting portion at least partly closes a clearance between the front end of the rectangular tube and the rear end of the tab. Thus, another member cannot intrude into the clearance.

The tab preferably is narrower than the tube.

The restricting portion preferably extends obliquely out between a front end edge of the locking plate and the second contact piece of the tab.

A surface of an extending end part of the restricting portion may be in contact with or proximately facing a surface of the second link.

At least one rib preferably projects at an angle from the first plate-like contact piece of the tab and a portion of the rib substantially contacts or proximately faces a corresponding lateral edge part of second plate-like contact piece of the tab.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 2:
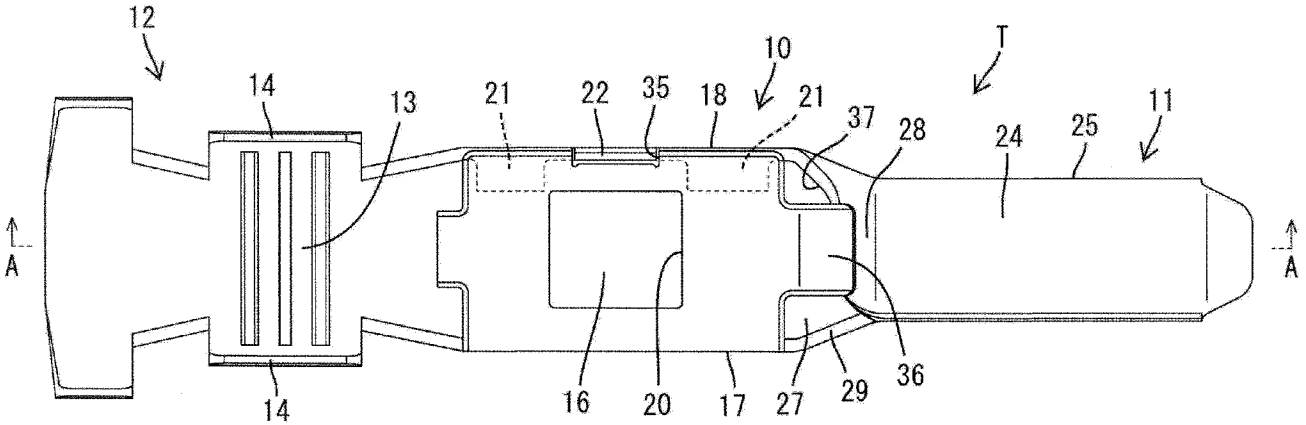
FIG. 2 is a bottom view of the terminal fitting.
Figure 3:
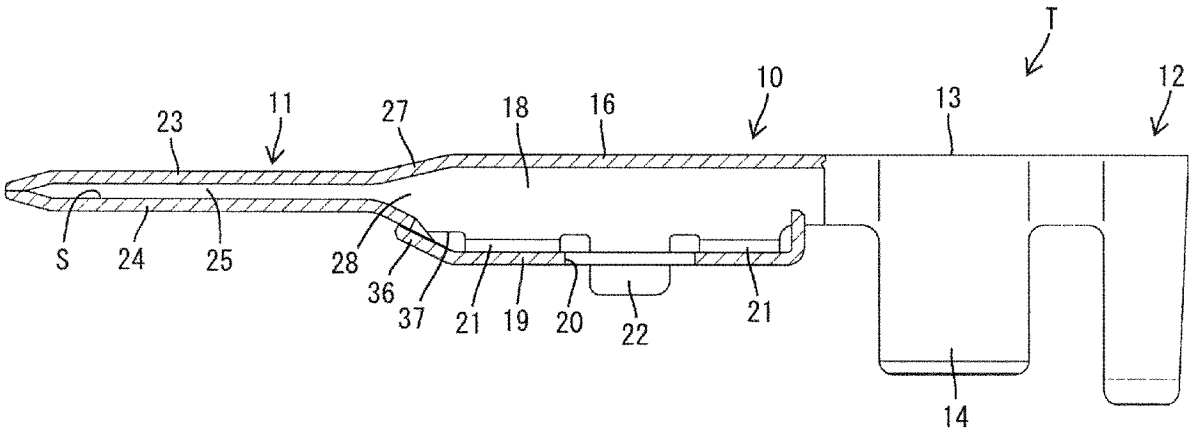
FIG. 3 is a section along A-A of FIG. 2.
Figure 4:
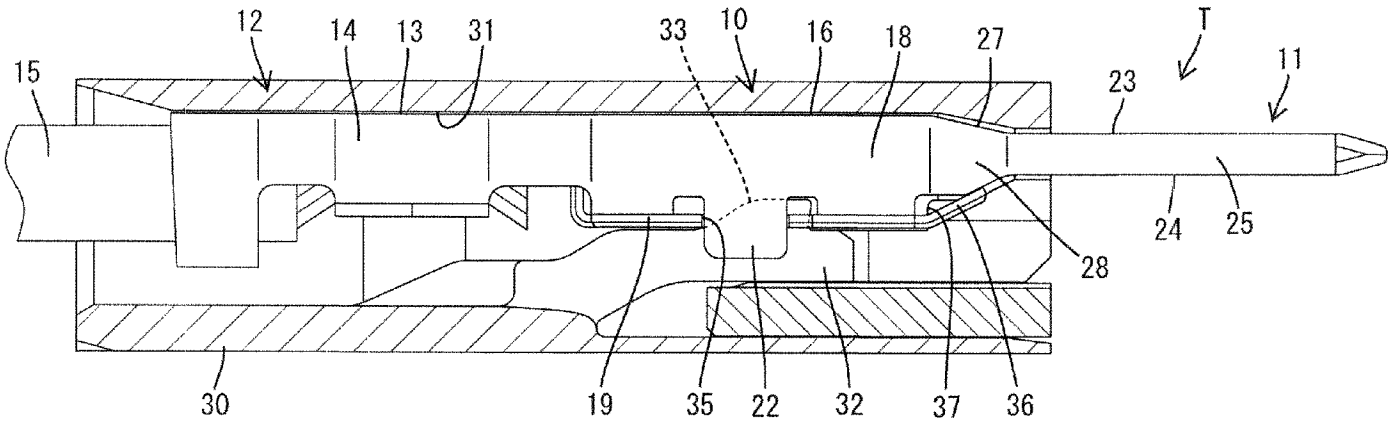
FIG. 4 is a section showing a state where the terminal fitting is inserted in a terminal accommodating chamber.

As shown in FIGS. 1 to 4, a male terminal fitting T of this embodiment has a substantially rectangular tube 10 and a tab 11 projecting forward from the tube 10. The terminal fitting T is long and narrow in forward and backward directions as a whole, and the rectangular tube 10 is a substantially central part of the terminal fitting T in forward and backward directions. As shown in FIG. 4, the terminal fitting T is to be inserted from behind into a terminal accommodating chamber 31 formed in a housing 30, and engages a locking lance 32 in the terminal accommodating chamber 31 to prevent the terminal fitting T from coming out backward. The locking lance 32 is formed with a locking projection 33 for locking the terminal fitting T.

Figure 1:
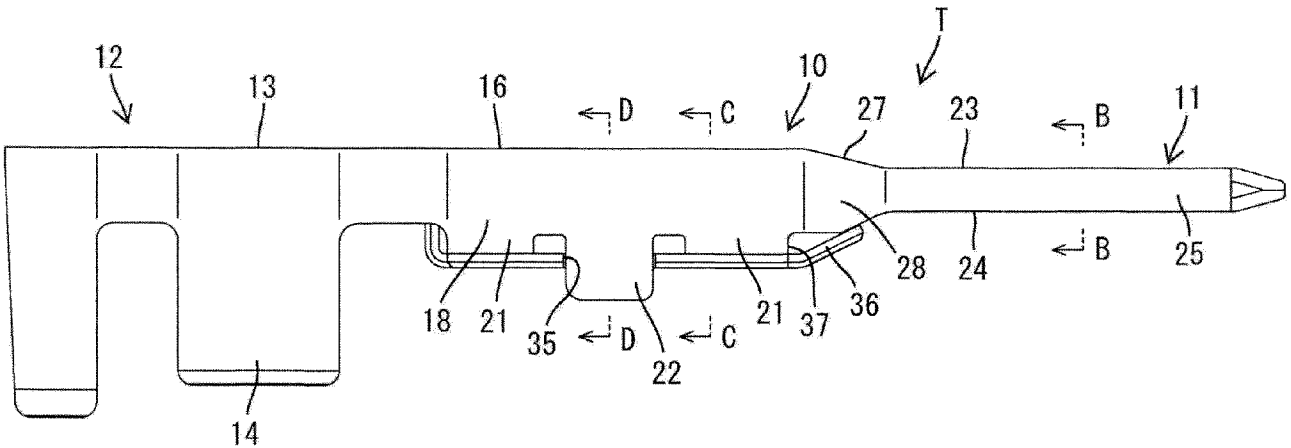
FIG. 1 is a side view of a terminal fitting according to one embodiment.

For the sake of convenience, vertical and lateral directions are based on the state where the terminal fitting T is inserted in the terminal accommodating chamber 31. As shown in FIGS. 1 to 4, the terminal fitting T includes a wire crimping portion 12 in the form of at least one open barrel extending back from the rectangular tube 10. As shown in FIG. 2, the wire crimping portion 12 is of a known form and has a base wall 13 and two crimping pieces 14 that extend at an angle from lateral edges of the base wall 13. The wire crimping portion 12 is to be crimped, bent or folded and electrically conductively connected to a front end part of a wire 15 in a state where relative displacements in forward and backward directions are restricted.

As shown in FIGS. 1 to 4, 6 and 7, the rectangular tube 10 comprises a substantially rectangular horizontal base plate 16, a flat rectangular left side plate 17 extending down at a substantially right angle from the left side of the base plate 16, a flat rectangular right side plate 18 extending down at a substantially right angle from the right side of the base plate 16 and at least one flat substantially rectangular locking plate 19 extending laterally at a substantially right angle from the end of the left side plate 17 opposite the base plate 16. The front and rear ends of the rectangular tube 10 are open toward the outside of the tube 10.

As shown in FIG. 2, a rear end of the base plate 16 is connected to the front end of the base wall 13 of the wire crimping portion 12, and rear ends of the left and right side plates 17 and 18 are connected to base ends of the left and right crimping pieces 14. The locking plate 19 is formed with a substantially rectangular locking hole 20 located in a substantial central part in forward and backward directions and in the lateral direction. As shown in FIG. 4, a front edge of the locking hole 20 is engaged with the locking projection 33 of the locking lance 32 to retain the terminal fitting T when the terminal fitting T is inserted properly into the terminal accommodating chamber 31.

As shown in FIGS. 2 and 3, the tube 10 has substantially flat front and rear supporting plates 21 extending laterally (e.g. leftward) at a substantially right angle from the extending end of the right side plate 18. The front supporting plate 21 is at a front part of the tube 10 before the front edge of the locking hole 20 and the rear supporting plate 21 is at a rear part of the tube 10 behind the rear edge of the locking hole 20. The upper or inner surface of the locking plate 19 is in contact with or proximately facing the outer or lower surfaces of the front and rear supporting plates 21. Thus, the supporting plates 21 cannot be seen even if the locking hole 20 is viewed from below the tube 10.

As shown in FIGS. 1 to 4, 6 and 7, the tube 10 includes a substantially flat rectangular stabilizer 22 extending out from the end of the right side plate 18 opposite the base plate 16. The stabilizer 22 is substantially flush with or parallel to the right side plate 18 and is in a substantially central part of the right side plate 18 in forward and backward directions, i.e. between the front and rear supporting plates 21.

As shown in FIGS. 1, 3 to 5, the tab 11 comprises first and second long narrow plate-like contact piece 23 and 24 that extend in forward and backward directions. The first and second plate-like contact piece 23 and 24 are joined by a long narrow fold panel 25 that extends in forward and backward directions. The plate-like contact pieces 23, 24 are bent about the fold panel 25 to be disposed in substantially opposed facing relationship. As shown in FIG. 2, the tab 11 is narrower than the rectangular tube 10 in the width direction.

Figure 5:
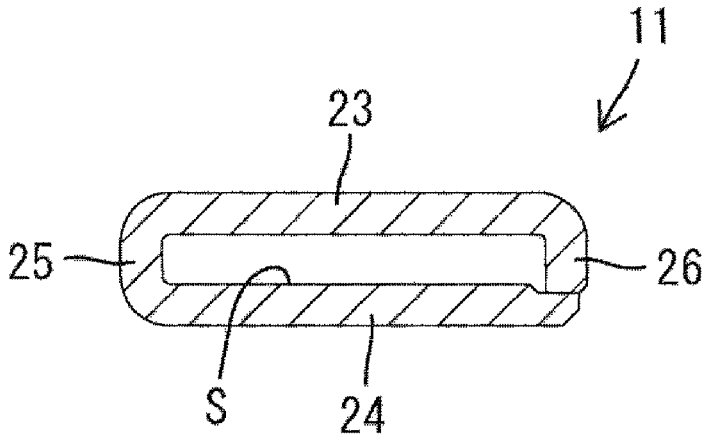
FIG. 5 is a section along B-B of FIG. 1.
Figure 6:
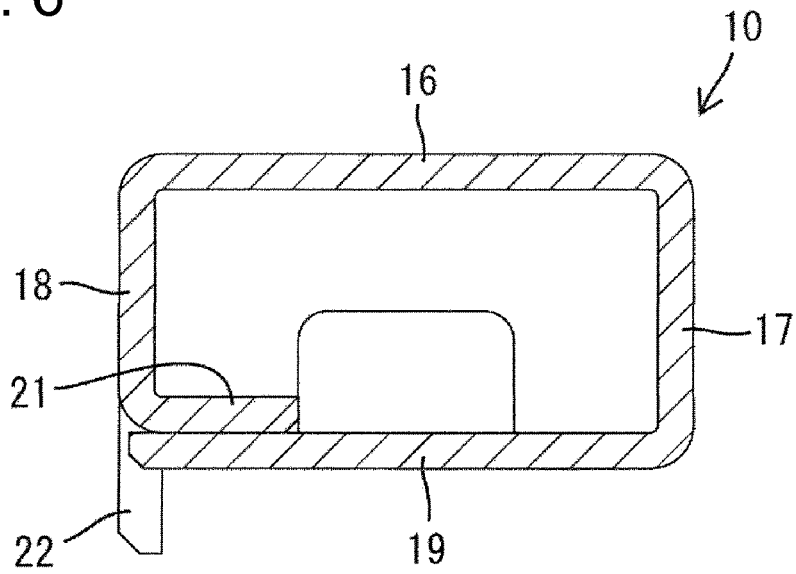
FIG. 6 is a section along C-C of FIG. 1.
Figure 7:
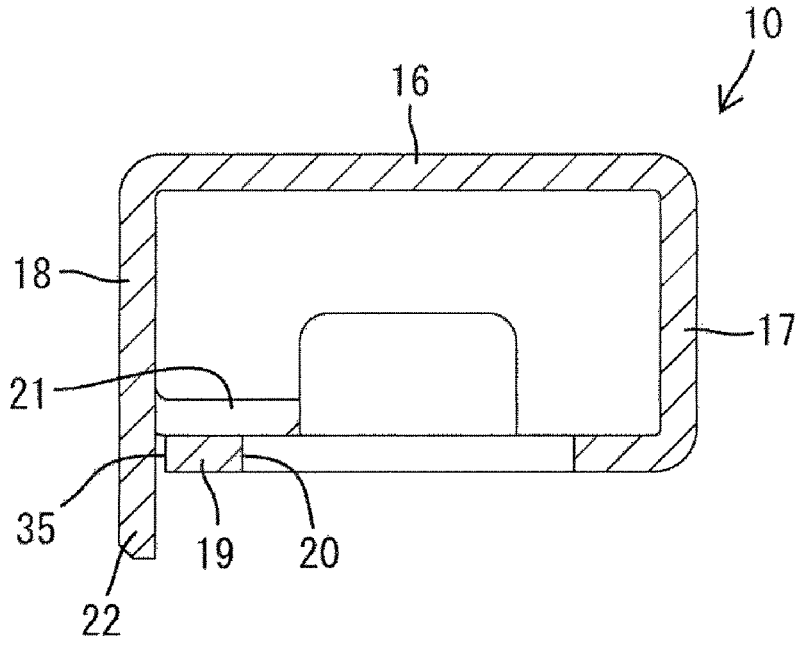
FIG. 7 is a section along D-D of FIG. 1.

As shown in FIG. 5, a rib 26 projects substantially orthogonally from the left edge of the first plate-like contact piece 23 and the end of the rib 26 is substantially contact with or proximately facing a corresponding left edge part of the second plate-like contact piece 24. Accordingly, a clearance S for increasing the thickness of the tab 11 is secured between the lower surface of the first plate-like contact piece 23 and the upper surface of the second plate-like contact piece 24. However, as shown in FIGS. 1, 3 and 4, the thickness of the tab 11 is smaller than the height of the rectangular tube 10.

Figure 8:
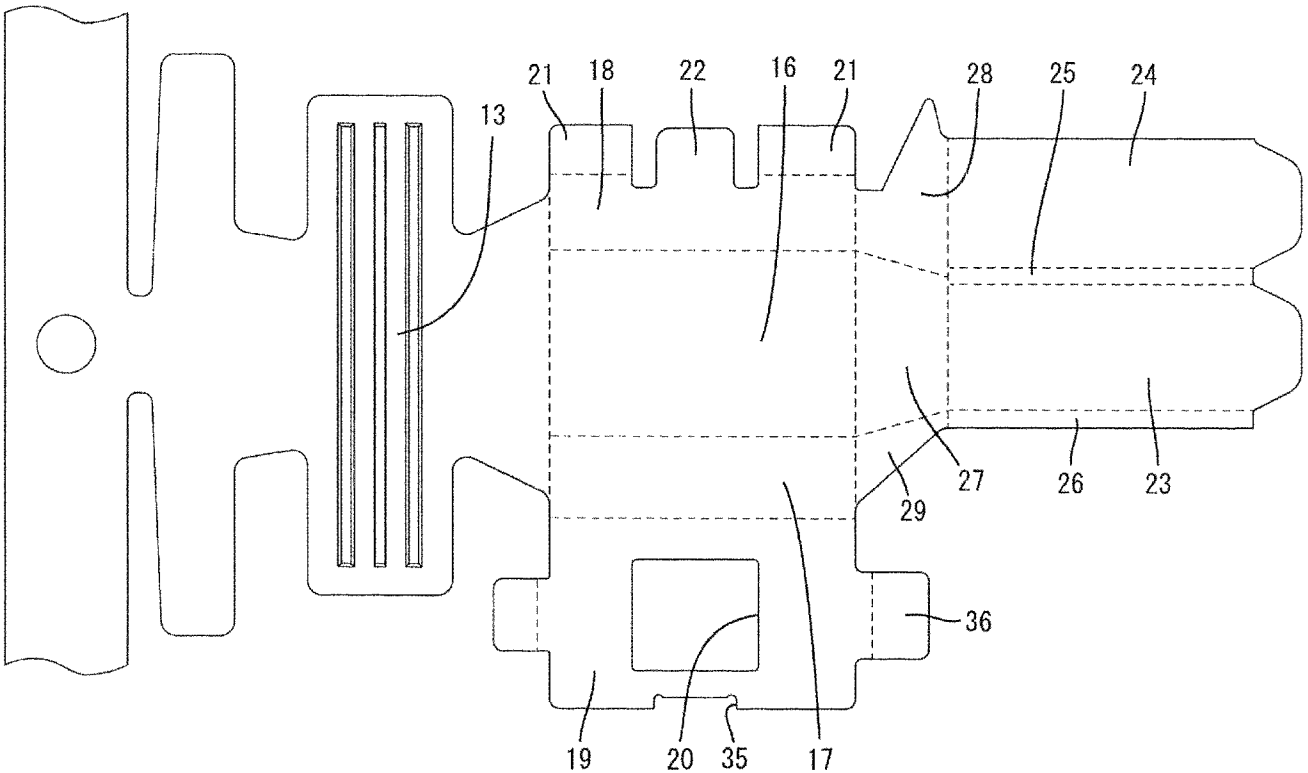
FIG. 8 is a development view of the terminal fitting.

The tab 11 and the tube 10 are connected via first, second and third links 27, 28 and 29. As shown in FIG. 8, the first link 27 is a substantially trapezoidal plate that links the entire width area of the front end of the base plate 16 and the rear end of the first plate-like contact piece 23. The third link 29 extends at a substantially right angle from the left edge of the first link 27 and links substantially the entire width area of the front end of the left side plate 17 and the rear end of the rib 26. As shown in FIGS. 1, 3 and 4, the second link 28 links an upper end area of the front end of the right side plate 18 formed with the stabilizer 22 and the entire width area of the rear end of the second plate-like contact piece 24. The plate surfaces of the right side plate 18 and the second plate-like contact piece 24 are at a substantially right angle. Thus, the second link 28 is in the form of a twisted plate.

The wire 15 connected to the wire crimping portion 12 may be pulled backward and would generate a backward pulling force on the base plate 16, which is connected directly to the bottom wall 13 of the wire crimping portion 12 and the right side plate 18, which is connected directly to the base plate 16 in the terminal fitting T. On the other hand, a backward displacement of the locking plate 19 is restricted because of the engagement of the locking hole 20 with the locking lance 32, but this locking plate 19 is not connected directly to the base plate 16, and the left side plate 17 is present between the locking plate 19 and the base plate 16. Thus, when the wire 15 is pulled e.g. backward, the base plate 16 and the right side plate 18 could be displaced backward relative to the locking plate 19 while deforming the left side plate 17, with the result that the rectangular tube 10 may be deformed improperly.

The invention takes measures to prevent improper deformation of the tube 10. More particularly, as shown in FIGS. 1, 2, 4 and 7, a substantially central part of a right edge of the locking plate 19 in forward and backward directions is recessed to form a cutout 35 that engages the stabilizer 22. The engagement of the stabilizer 22 and the cutout 35, restricts relative (e.g. backward) displacements of the right side plate 18 formed with the stabilizer 22 and the locking plate 19 formed with the cutout 35 to prevent improper deformation of the rectangular tube 10.

As shown in FIG. 2, an engagement margin between the stabilizer 22 and the cutout 35 in the lateral direction is equal to the plate thickness of the stabilizer 22 and hence is small. A strong backward pulling force on the wire 15 and the wire crimping portion 12 acts on the base plate 16 and could cause the right side plate 18 and the stabilizer 22 to incline rightward about the base plate 16 and to displace out in an opening direction sufficiently for the stabilizer 22 to disengage from the cutout 35.

However, the right side plate 18, which is formed with the stabilizer 22, is connected to the second plate-like contact piece 24 via the second link 28, as shown in FIGS. 1 and 2, the fold panel 25 of the tab 11 is connected substantially linearly to a boundary between the first and second links 27, 28 and a substantially right-angled boundary is formed between the right edge of the base plate 16 and the upper edge of the right side plate 18, as shown in FIG. 8. Thus, if the right side plate 18 is displaced in an opening direction, the second plate-like contact piece 24 is displaced in a direction away from the first plate-like contact piece 23 with the fold panel 25 as a support.

The second plate-like contact piece 24 would be displaced with the right side plate 18. However, a restricting portion 36 is formed on the locking plate 19, as shown in FIGS. 1 to 4. The restricting portion 36 is a substantially flat rectangular plate that extending obliquely up or in toward the front from a widthwise central part of the front end of the locking plate 19. The upper or inner surface of an extending end part of the restricting portion 36 is in contact with or proximately facing the outer surface (lower surface) of the second link 28. Thus, the restricting portion 36 restricts displacement of the second plate-like contact piece 24 in the opening direction away from the first plate-like contact piece 23. This restriction of an opening displacement of the second plate-like contact piece 24 further restricts an opening displacement of the right side plate portion 18 to the right. Therefore, the stabilizer 22 cannot disengage from the cutout 35.

As shown in FIG. 2, a clearance 37 is formed between the front end edge of the locking plate 19 and the rear edge of the second link 28. Thus, the tab 11 of one terminal fitting T may intrude into the tube 10 of another terminal fitting T through the clearance 37 when storing and transporting a multitude of terminal fittings T. However, the restricting portion 36 partly closes the clearance 37, an opening area of the clearance 37 is narrowed to prevent the intrusion of another member into the tube 10 through this clearance 37 can be prevented.

The invention is not limited to the above described embodiment. For example, the following embodiments also are included in the scope of the invention.

The stabilizer 22 is flush with the right side plate 18 in the above embodiment, but it may be connected to the right side plate via a step.

Although the restricting portion 36 is a single plate in the above embodiment, it may be bent or curved to increase bending rigidity.

The restricting portion 36 contacts only the second linking portion 28 in the above embodiment. However, the restricting portion 36 may contact both the second linking portion 28 and the second contact piece 24 or may contact only the second contact piece 24.

The restricting portion 36 is formed only on the locking plate 19 in the above embodiment. However, the restricting portion 36 may be formed only on the left side plate 17, only on the base plate 16, on the locking plate 19 and the left side plate 17, on the locking plate 19 and the base plate 16, on the left side plate 17 and the base plate 16 or on all of the locking plate 19, the left side plate 17 and the base plate 16.

The restricting portion 36 closes only a part of the opening area of the clearance 37 between the front end of the rectangular tube 10 and the rear end of the tab 11 in the above embodiment. However, the restricting portion 36 may close the entire opening area of the clearance 37 between the rectangular tube portion 10 and the tab 11.

The restricting portion 36 need not close the clearance 37 between the front end of the rectangular tube 10 and the rear end of the tab 11.

The lock 20 is a through hole in the above embodiment, but may be a projection.

What is claimed is:

1. A terminal fitting, comprising:

a tube (10) formed from a base plate, first and second side plates projecting from the base plate and a locking plate projecting from the first side plate toward the second side plate, at least one stabilizer projecting out from the second side plate, a lock formed in the locking plate for engaging a locking lance of a terminal accommodating chamber of a connector housing;

a tab extending forward from the tube and having two plate-like contact pieces placed substantially one over the other and joined unitarily along a fold portion that extends in forward and backward directions;

a wire connection portion extending back from the tube;

a first link linking a front end of the base plate and a rear end of the first plate-like contact piece;

a second link linking a front end of the second side plate and a rear end of the second plate-like contact piece; and a restricting portion projecting from one of the plates forming the tube and contacting at least one of the second link and the second plate-like contact piece to restrict a displacement of the second plate-like contact piece away from the first plate-like contact piece.

2. The terminal fitting of claim 1, wherein the base plate is substantially parallel to the first and second plate-like contact pieces and is connected to a base wall of the wire connection portion.

3. The terminal fitting of claim 1, wherein the at least one stabilizer is a plate projecting out of the tube substantially parallel to or flush with the second side plate from an end of the second side plate opposite the base plate.

4. The terminal fitting of claim 1, wherein the tube further comprises at least one cutout or recess formed in the locking plate and engaging the stabilizer to restrict relative displacements of the locking plate and the second side plate in forward and backward directions.

5. The terminal fitting of claim 4, wherein the at least one cutout or recess is formed by recessing an extending edge of the locking plate.

6. The terminal fitting of claim 1, wherein the restricting portion at least partly close a clearance between a front end the tube and a rear end of the tab.

7. The terminal fitting of claim 1, wherein the tab is narrower than the tube.

8. The terminal fitting of claim 1, wherein the restricting portion extends obliquely from a front end of the locking plate.

9. The terminal fitting of claim 8, wherein a surface of an extending end part of the restricting portion is in contact with or proximately facing a surface of the second link.

10. The terminal fitting of claim 1, wherein at least one rib projects substantially orthogonally from the first plate-like contact piece and a portion of the rib is in contact with or proximately facing a corresponding lateral edge part of second plate-like contact piece.

* * * * *